United States Patent [19]

Figueres

[11] 3,930,700

[45] Jan. 6, 1976

[54] INFORMATION STORAGE SYSTEM

[76] Inventor: Maurice C. Figueres, 209 W. 21st St., New York, N.Y. 10011

[22] Filed: Sept. 30, 1974

[21] Appl. No.: 510,710

[52] U.S. Cl. ..... 312/183; 283/63 R; 283/54; 40/159

[51] Int. Cl.[2] ..... B42D 15/04; G09F 7/12

[58] Field of Search ..... 281/5, 15; 402/79, 502; 312/183, 184, 189, 209, 234.1, 234.5; 283/54, 63 R, 66; 40/159

[56] References Cited

UNITED STATES PATENTS

| | | | |
|---|---|---|---|
| 1,634,240 | 6/1927 | Wilford | 283/54 |
| 2,014,267 | 9/1935 | Sherman | 312/183 |
| 2,039,752 | 5/1936 | Thomas | 402/79 |
| 2,215,163 | 9/1940 | Shedd | 281/15 R |
| 3,330,581 | 7/1967 | Wallerstrom | 281/5 |
| 3,520,560 | 7/1970 | Isaac | 283/63 R |
| 3,817,588 | 6/1974 | Helmers | 312/209 |

*Primary Examiner*—Casmir A. Nunberg
*Attorney, Agent, or Firm*—Kenyon & Kenyon Reilly Carr & Chapin

[57] ABSTRACT

One or more pages of a publication are provided with a pre-printed perforated area which may be removed from the remainder of the page or with a pre-printed form which may be peeled from the page. The perforated areas provide individual cards when removed from the page, while the peelable forms are placed on a backing when they are separated from the page. The cards and backings are provided with shaped cut-outs at one edge for placement in a suitable storage container.

11 Claims, 6 Drawing Figures

INFORMATION STORAGE SYSTEM

This invention relates to an information storage system.

In the past, it has been a common practice to provide information in magazines, newspapers, reviews or journals which is related with particular subject matters such as tax or legal rules, regulations of government agencies, accounting rules, economic indicators with or without graphs, travel information, authors' biographies accompanied or not with their portrait and the like. Generally this information has been embodied in the publication in such a way that the reader who may desire to retain such information for future use must store the publication itself or remove the desired material, for example either by tearing out the page of the publication or by cutting out the information with a scissors. These techniques have, however, usually been inconvenient and impractical for storage and retrieval. In many cases, the removed materials become lost or misplaced.

It has also been known to provide various publications or periodicals with insert sheets which can be individually removed and used for various purposes. In some cases, the insert sheet has been provided with perforated portions to which coupons are attached in a perforated manner for removal, for example, for redeeming articles of merchandise. However, this technique has not been used for classifying and storing pieces of information in an information storage system.

Accordingly, it is an object of this invention to provide a system for removing information from publications and for storing the information in a readily accessible manner.

It is another object of the invention to provide a means of easily removing information from a publication for a series of articles or publications.

Briefly, the invention provides an information storage system for storing and retrieving information published in a series of publications. In accordance with the system at least some of the publications include at least one page having a plurality of selected areas each containing printed information related to a preselected subject matter. Each such area of a page is made so as to be removable from the page as a form for storage and subsequent retrieval. In addition, the system includes at least one storage container for receiving and storing a plurality of removed forms each of which contains information relating to a common subject matter for subsequent reference.

In one embodiment, at least some of the printed areas are surrounded by a perforation so that the area may be removed from the publication as a card. In such a case, the page is made of heavy weight paper or the like so that the card has a degree of rigidity to be used as is. The card is also provided with one or more shaped cut-outs in an edge to cooperate with a means within the storage container for alignment of the cards in the container.

In another embodiment, the printed areas of the publication are in the form of releaseably mounted forms which can be peeled from the pages of the publication. After removal, each such form is mounted on a suitable backing, for example, by means of an adhesive on the peeled form. The backing may also contain one or more cut-outs in an edge to cooperate with a means in the storage container to align the received backings and the related forms in the container.

In order to facilitate storage of the information obtained from a publication, the system may also use a transparent sheet which is folded about a removed form, i.e. card of peeled form. Such a sheet has a front portion, a back portion and a flap. The front and back portions are of a size larger or equal to the size of the removed form and serve to sandwich the form therebetween while the flap is folded from one of the portions over the other of the portions to form a self-contained unit. The information which is thus encased can then be filed in a suitable storage container in accordance with the subject matter contained in the form. In addition, the encased form as well as the front and back portions of the transparent sheet each have one or more preshaped cut-outs which receive a suitable aligning means within the storage container for aligning purposes.

Additionally, the folded transparent sheet may also be used to enclose a form or other item of information not provided with cut-outs. In this case, an item which is not otherwise adapted for mounting in a storage container, such as within a Rolodex system, can be readily stored for subsequent retrieval. For example, a business card or a small ad cut from a newspaper or other items which would fit into the size of the plastic component can be readily inserted and thereafter placed into a storage container of an information retrieval system. The plastic component thus has some universal usage and has the characteristic of being able to add special types of data without being limited to a particular size, shape or thickness into the information storage system.

Each of the areas to be removed from a publication may contain printed information on front and back. Further, each of the areas may be made of a standard configuration such as in the configuration of a file card, a business card, a Rolodex-shaped card or a Wheeldex-shaped card. In addition any one or more of these shapes may be used separately or in combination and in any location on the publication page to provide a readily removable means of standard configuration for convenient selection, storage, update and ready access of authoritative information.

The invention thus provides a reader with a convenient, efficient and inexpensive system for the retention, storing, retrieving and updating of a file maintaining information in various subject matters.

The information on any particular printed area may be of any suitable type. For example, for ease of filing, the information may contain a title, a date, the source of the information, the title of the publication with its number, volume, date or month as usually indicated on a cover and the like.

In addition, a single storage container may be used to contain cards relating to more than one subject matter. In such a case, each set of cards may be color-coded to indicate the different subject matters. For example, use can be made of the stored cards as a learning aid. Also, in the case of a theatrical play, the several parts of the play may be subdivided into the various color-coded cards. Each part would then have a set of different colors or a different distinctive visual symbol. In any case, this may well enable an actor or actress to learn his or her part more easily and rapidly.

These and other objects and advantages of the invention will become more apparent from the following detailed description and appended claims taken in conjunction with the accompanying drawings in which: FIG. 1 illustrates a storage card in accordance with the invention;

Figure 2:
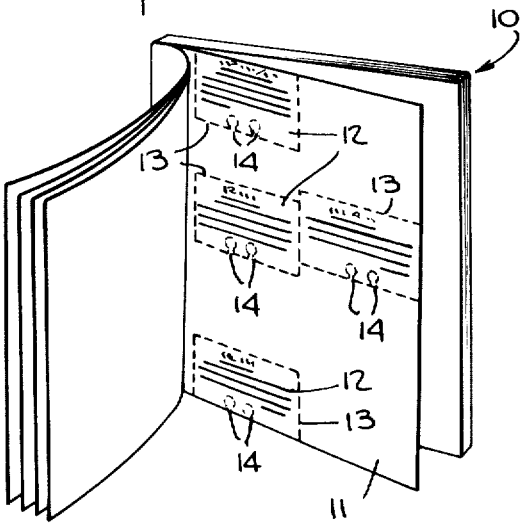
FIG. 2 illustrates a perspective view of a publication containing a page having a plurality of selected areas containing printed information which can be removed from the publication.

Referring to FIG. 2, a publication 10 such as a serially produced publication, contains at least one page 11 having a plurality of selected areas 12, for example, four areas, each containing printed information. In addition, the page 11 has a perforation or a line of weakening 13 about each area 12 so as to permit removal of each area 12 as a storage card from the page 11. To this end, the paper 11 is made of heavy weight paper material such as about 35 to 45 pound weight to enhance the rigidity of the removed card. Each area 12 also includes a means for permitting storing of the removed card for subsequent reference. As shown, the means is in the form of a pair of shaped cut-outs on one edge. These cut-outs 14 may also be perforated so as to be formed during or after removal of the area 12 from the page 11 or may be pre-punched.

Referring to FIG. 2, each removed area 12 which is in the form of a card, contains information for example, in printed form relating to a particular subject matter. This information may be printed on both the front and back sides of the card or may be printed on only one side. In addition, the information should contain a reference to the publication and the date along with a title of the subject matter for filing purposes. This information is located along an upper margin 15 of the card.

Figure 3:
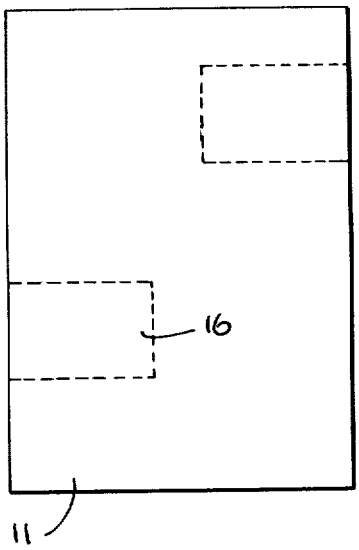
FIG. 3 illustrates a view of a page of a publication containing a peelable form in accordance with the invention.
Figure 4:
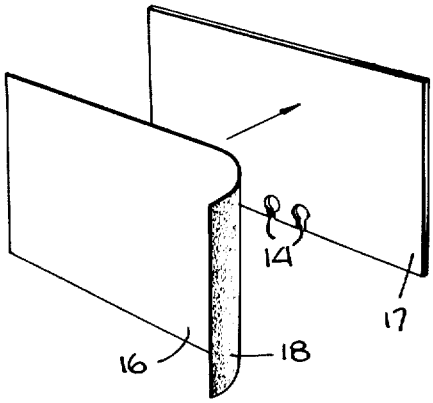
FIG. 4 illustrates an exploded view of a peeled form and a backing in accordance with the invention.

Referring to FIGS. 3 and 4, wherein like reference characters indicate like parts as above, if the publication 10 is made of a lightweight paper such as newspaper, instead of using a perforation about each area 12, each area 12 may be in the form of a peelable strip or form 16 which can be readily removed from the page 11 of the publication. In such a case, the peeled form 16 is mounted on a separate heavy weight or stiff backing 17 as shown in FIG. 4 to enhance the degree of rigidity of the form 16. To this end, the peeled form 16 may contain an adhesive 18 which permits removal from the publication page 11 as well as mounting on the backing 17. In addition, the backing 17 is provided with means such as shaped cut-outs 14 for alignment purposes within a suitable storage container in a similar fashion to the card 12 described above. To this end, the backing 17 is of a larger dimension than the strip 16 to allow the strip 16 to be applied without covering over the cut-outs 14. Alternatively, both the peelable form 16 and the backing 17 may include shaped cut-outs which are placed in alignment.

Figure 6:
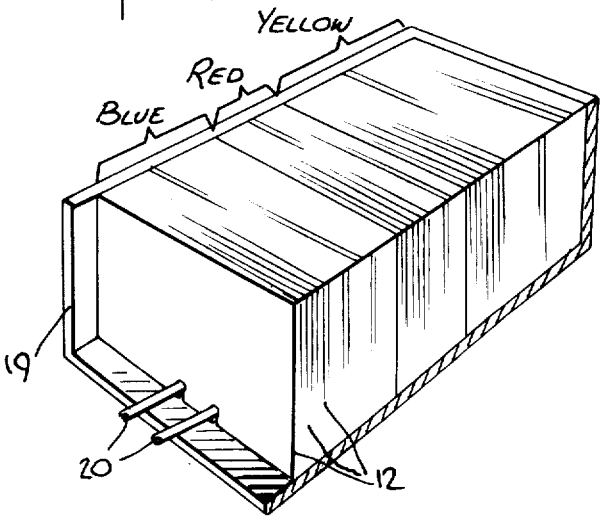
FIG. 6 illustrates a storage container containing a plurality of color coded forms in accordance wih the invention.

Referring to FIG. 6, a storage container 19 for example of rectangular box-like construction, is provided for retaining and storing the various cards 12 and forms 16 removed from a publication. The storage container 19 also includes a means, for example, two elongated rods or rails 20, for reception in the cut-outs 14 of a card 12 or backing 17 in order to align the respective cards and backings within the storage container. In addition, where a storage container 19 is used to store information relating to more than one subject matter, the various cards 12 and forms 11 may be color-coded as indicated in blue, red and yellow, for example. The color-coding may also be used to indicate different sub-areas of a particular subject matter for ease of storage and retrieval.

Figure 5:
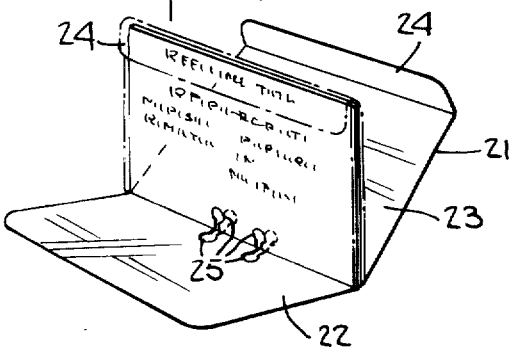
FIG. 5 illustrates a printed form encased within a transparent sheet in accordance with the invention.

Referring to FIG. 5, in order to preserve the life of a removed area 12 of a publication, use can be made of a prefolded transparent sheet 21. As shown, the sheet 21 includes a front portion 22, a back portion 23 and a flap 24 which are each integrally connected to each other. The front and back portions 22, 23 serve to sandwich a card 12 or backed form 16 therebetween while the flap 24 serves to fold over the front portion 22 to encase the card 12 or form 16. Each of the front and back portions 22, 23 are also provided with shaped cut-outs 25 to align with and match the cut-outs 14 in the card or backed form for purposes of storage in the storage container. The prefolded sheet 21 is made, for example, of a plastics material with sufficient rigidity to retain its folded shape with or without a card 12 or backed form 16 encased. As shown, the corners of the sheet 21 may be rounded to avoid sharp corners.

Figure 1:
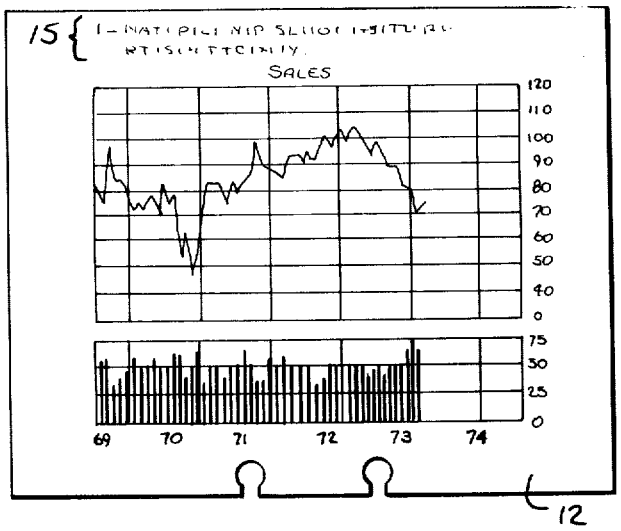

The invention thus provides a system by means of which various pieces of information relating to a particular subject matter can be easily removed from a page of publication or the like and stored for easy retrieval at a later time. The system is particularly useful in maintaining the information on a particular subject matter current. For example, where the information contained on a card as indicated in FIG. 1, relates to sales volume or commodity indexes or the like which are published on a monthly basis, the most recent card may be placed in storage with an earlier card removed. In other cases where the information contained on periodically published matters is of interest, all of the cards may be retained in the chronological sequence in a storage container or the like.

It is to be noted that a publication may contain any combination of the cards or peelable forms. For example, one page may contain both peelable forms and perforated areas. Also, one page may only contain perforated areas while another page contains peelable forms. As a practical matter, however, it is expected that the pages of a publication would be made in the same way so that the information is contained in the same type of area, i.e. perforated or peelable.

What is claimed is:

1. In a publication including a plurality of pages, at least one page being of heavy weight and having a plurality of selected areas thereof containing printed information, a line of weakening about each respective area for removal of each said area as a storage card from said one page, each said removed storage card having means for permitting storage of said removed card for subsequent reference.

2. In a publication as set forth in claim 1, said means including a pair of shaped cut-outs on one edge.

3. In a publication including a plurality of pages, at lease one page having a plurality of pre-printed peelable forms adhesively secured in a removable manner thereon, each said form having an adhesive thereon for securing said form to a rigid backing having a pair of shaped cut-outs on one edge for permitting storage of a removed form for subsequent reference.

4. In combination, a publication including a plurality of pages;

a plurality of forms containing printed information releaseably mounted on at least one of said pages;

a plurality of backings, each said backing being sized to receive a selective one of said removed forms thereon and having shaped cut-outs on one edge; and an adhesive on a backside of a removed form for securing a removed form to a selected one of said backings.

5. The combination as set forth in claim 4 which further includes a storage container for receiving a plurality of said backings with a respective form thereon, said container having means for reception in said cut-outs to align said received backings therewith.

6. In combination a form containing printed information; and a transparent sheet folded about said form, said sheet having a front portion, a back portion and a flap, said front and back portions having said form sandwiched therebetween with said flap folded from one of said portions over the other of said portions, said portions each having a shaped cut-out in alignment with each other.

7. The combination as set forth in claim 6 wherein said form has at least one shaped cut-out at one edge in alignment with said cut-out in said portions of said sheet.

8. The combination as set forth in claim 6 which further included a storage container for receiving a plurality of said folded transparent sheets and enclosed forms, said container having means for reception in said cut-outs to align said folded transparent sheets therewith.

9. An information storage system comprising a series of publications, at least some of said publications including at least one page having a plurality of selected areas thereof each containing printed information relating to a preselected subject matter, a line of weakening about each said area for removal of each said area from said page as a form each said area having cut-outs in an edge thereof; and at least one storage container for receiving and storing a plurality of removed forms containing information relating to common subject matter for subsequent retrieval, said container having means for reception in said cut-outs to align received forms in said container.

10. An information storage system comprising a series of publications, at least some of said publications including at least one page having a plurality of selected areas thereon each containing printed information relating to a preselected subject matter, each said area being peelable from said page as a form and having an adhesive thereon;

a plurality of backings, each said backing being sized to adhesively receive a respectively form thereon and having cut-outs in an edge thereof; and at least one storage container for receiving and storing a plurality of said backing mounted forms containing information relating to common subject matter for subsequent retrieval, said container including means for reception in said cut-outs of said backings to align received backings in said container.

11. In combination a form containing printed information; and a transparent sheet about said form, said sheet having a front portion and a back portion having said form sandwiched therebetween, said portions each having at least one pre-shaped cut-out along an edge thereof in alignment with a cut-out in the other portion for storing of the encased form in a container in alignment with other like encased forms.

* * * * *